US005391011A

United States Patent [19]

Gueret

[11] Patent Number: 5,391,011

[45] Date of Patent: Feb. 21, 1995

[54] APPLICATOR FOR MAKEUP OR FOR A HAIR-CARE PRODUCT

[75] Inventor: Jean-Louis H. Gueret, Paris, France

[73] Assignee: L'Oreal, Paris, France

[21] Appl. No.: 190,526

[22] Filed: Feb. 2, 1994

[30] Foreign Application Priority Data

Feb. 9, 1993 [FR] France ..... 9301398

[51] Int. Cl.[6] ..... A45D 40/22

[52] U.S. Cl. ..... 401/126; 132/218; 132/320; 206/15.2; 215/286; 220/320

[58] Field of Search ..... 401/60, 126, 129; 215/286, 290, 293, 294; 220/322; 206/15.2, 15.3; 132/320, 218

[56] References Cited

U.S. PATENT DOCUMENTS

| | | | |
|---|---|---|---|
| 328,115 | 10/1885 | Gilberds | 215/286 X |
| 389,234 | 9/1888 | Mayo | 206/15.3 |
| 423,928 | 3/1890 | Howe | 215/286 |
| 1,944,968 | 1/1934 | Daniel | 220/322 |
| 4,667,856 | 5/1987 | Nelson | 220/322 X |
| 4,949,858 | 8/1990 | Sheridan . | |
| 5,236,409 | 8/1993 | Romanauskas | 215/286 X |

FOREIGN PATENT DOCUMENTS

| | | | |
|---|---|---|---|
| 924786 | 8/1947 | France | 401/60 |
| 955029 | 1/1950 | France | 215/290 |
| 1436613 | 3/1966 | France . | |
| 3602946 | 8/1987 | Germany . | |

*Primary Examiner*—Steven A. Bratlie

[57] ABSTRACT

Applicator for a cosmetic product to be applied, including a reservoir containing the product, a removable cap for closing the reservoir, an application member on an end of a rod connected to the cap, and a handle for the cap articulated about an axis of the cap, pivotable between a folded-up position against the reservoir, and an extended position at an angle to the reservoir, and including at least one arch of which the dimensions are such that, in the folded-up position, the arch surrounds the reservoir, the arch being equipped with a locking stop interacting with a base of the reservoir, in the folded-up position, which interaction holds the closure bearing surface on the seat in a leaktight manner.

11 Claims, 2 Drawing Sheets

200
210
211
212
212A
212B
212C
213
214
220
221
222
223
230
231
232
233
234
300
310
311
312
313
314
315A
315B
316A
316B
320
321
322
323
330
331
332
333

APPLICATOR FOR MAKEUP OR FOR A HAIR-CARE PRODUCT

BACKGROUND OF THE INVENTION

1. Field of the Invention

The present invention relates to an applicator for makeup or for a hair-care product; such an applicator is used, for example, for applying a reinforcer, also known as mascara, on the eyelashes, or for applying eye liner, eye shadow, nail varnish or the like.

2. Background Art

An applicator for makeup or for a hair-care product generally includes a reservoir containing the product to be applied and a removable cap which is intended to close the reservoir; a rod is integral with the cap at one of its ends and carries, at its other end, a member for applying the product, such as a brush or a slim brush; in the position of closure of the reservoir by the cap, the application member is immersed in the reservoir; when the cap and the rod are removed from the reservoir, a certain amount of product is taken up on the brush or the slim brush and this can then be applied.

An applicator for makeup, generally kept in a handbag or a makeup bag, must be as compact as possible, and this also applies to its length. Moreover, it must be practical to use, both from the standpoint of its opening and during application of the makeup product. Similarly, for a hairdresser, a member for applying a hair-care product of any sort may be of compact size.

The subject of the present invention is an applicator for makeup or for a hair-care product which fully meets the above-described requirements better than applicators known hitherto.

SUMMARY OF THE INVENTION

Thus, according to the invention, an applicator for makeup or for a hair-care product, including a reservoir containing the product to be applied, a removable cap intended to close the reservoir, an application member carried by the end of a rod integral with the cap, the cap having a closure bearing surface intended to interact with a seat made in line with the mouth of the reservoir, is characterized in that a handle is articulated about an axis carried by the cap, the handle including at least one arch of which the dimensions are such that, in the completely folded-up position of the handle, the arch surrounds the reservoir, the arch being equipped with a locking stop interacting with the base of the reservoir, in this completely folded-up position of the handle, this interaction applying the closure bearing surface of the cap in a leaktight manner on the seat made in line with the mouth of the reservoir.

The application member may include a brush, a slim brush or an end made from optionally flocked foam.

The base of the reservoir advantageously interacts with the locking stop of the arch by a positioning counterstop.

According to one embodiment, the cross section of the reservoir and the arch have the shape of a rectangle; the axis of articulation of the handle is parallel to the small side of the rectangle; as a variant, the axis of articulation of the handle is parallel to the large side of the rectangle.

According to a further embodiment, the longitudinal section of the reservoir has the shape of a trapezium and the arch matches this trapezoidal shape; the arch is a rectangular plate in which an opening of trapezoidal shape has been made.

According to a further embodiment, the reservoir has, at its periphery, recesses in which the arch is fitted to take up position; the arch is closed on one side by a wall.

Regardless of the variant, the articulation of the handle is preferably arranged so as to define stable positions of orientation of the handle with respect to the cap.

BRIEF DESCRIPTION OF THE DRAWINGS

In order to facilitate understanding of the subject of the invention, a description will now be given, by way of a purely illustrative and non-limiting example, of an embodiment shown in the appended drawings.

In these drawings.

DESCRIPTION OF THE PREFERRED EMBODIMENTS

Figure 1:
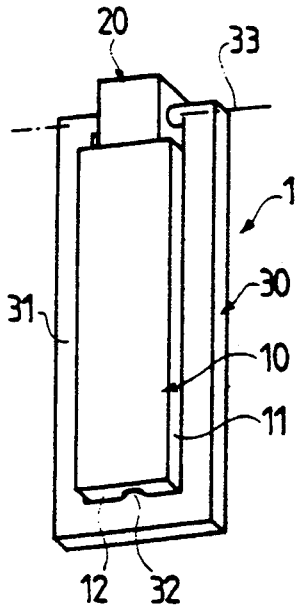
FIG. 1 is a perspective view of an applicator according to the invention in the closed position.
Figure 2:
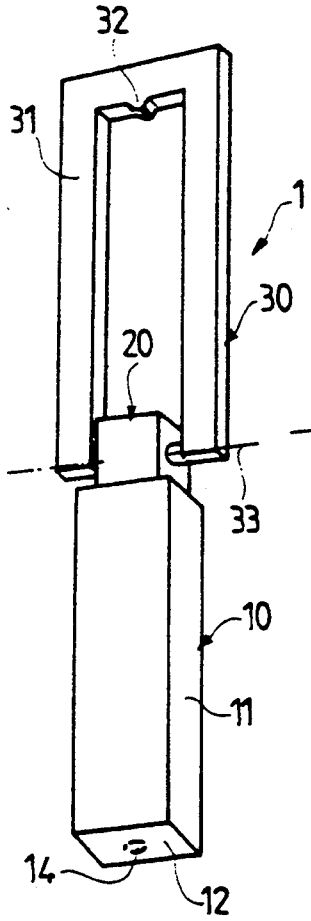
FIG. 2 is a perspective view of the applicator in FIG. 1 in a position during opening.
Figure 3:
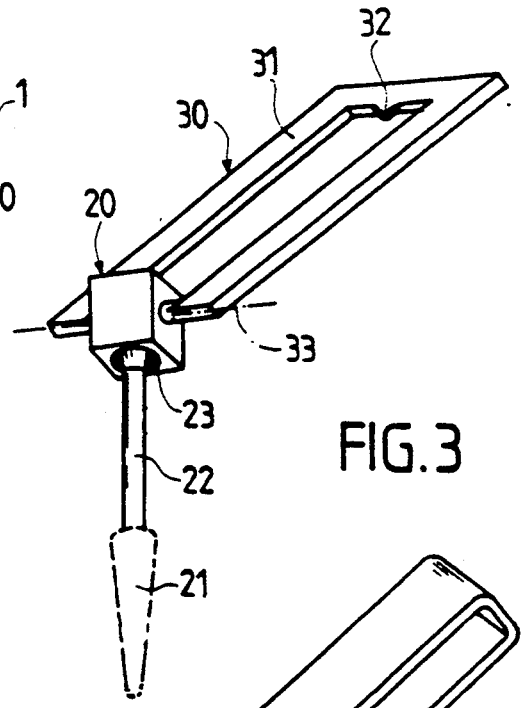
FIG. 3 shows the cap, the rod and the brush of the applicator in FIGS. 1 and 2, outside the container, in an application position.

FIGS. 1 to 3 show a first variant of the applicator according to the invention. According to these figures, an applicator 1 includes a reservoir 10 of parallelepipedal shape with a cross section of rectangular shape; a cap 20 makes it possible to close the reservoir 10 which contains the makeup product.

The cap 20 carries a rod 22 equipped, at its end, with an application brush 21, and has a closure bearing surface 23, in this case hollowed out, interacting with a seat (not shown) made in line with the mouth of the reservoir 10.

A handle 30 is articulated on the cap 20 about an axis 33; the handle 30 consists of an arch 31 in the general shape of a rectangular U extending in a plane passing through the axis 33; the thickness of the arch 31 is smaller than its width.

The bar linking the two branches of the U of the arch 31 has, on the side inside the arch 31, a locking stop 32 produced in the form of a stud. The body 11 of the reservoir 10 has a base 12, in the center of which there is a counterstop 14, in this case a housing, with which the locking stop 32 will interact; this interaction ensures, on the one hand, correct relative positioning of the handle 30 when it is in the foldedup position, such as shown in FIG. 1, and, on the other hand, in this same folded up position, leaktight gripping of the bearing surface 23 on the seat made in line with the mouth of the reservoir 10; this gripping is obtained by virtue of the respective dimensions of the arch 31 and of the body 11 and by virtue of the elasticity of the piece 31 in the shape of an arch along the longitudinal axis.

These arrangements lead to an applicator which is compact and easy to use; when the handle 30 has been unfolded by an angle such that the stop 32 is no longer in line with the base 12 of the reservoir 10, FIG. 2 showing the maximum position in which the handle has turned through 180° with respect to the cap 20, it is easy to open the applicator by separating the cap 20 from the reservoir 10 by means of a translational movement; it is, for example, unnecessary to carry out a rotational movement as is the case, most frequently, when the cap 20 is screwed onto the reservoir 10. Moreover, the articulation of the handle 30 on the cap 20 may be provided so as to ensure various stable positions of the handle 30 with respect to the cap 20, and thus of the rod 22 and the brush 21, one of these positions being shown in FIG. 3. This enables the user to adapt the applicator to his requirements, his habits and the nature of the makeup.

FIGS. 4 to 8, respectively 4 and 5–6 and 7–8, show three further variants of applicators according to the invention; in these figures, elements similar to those of the variant in FIGS. 1 to 3, which has just been described, bear the same reference numerals increased by 100 and by multiples of 100, respectively 100, 200 and 300.

Figure 4:
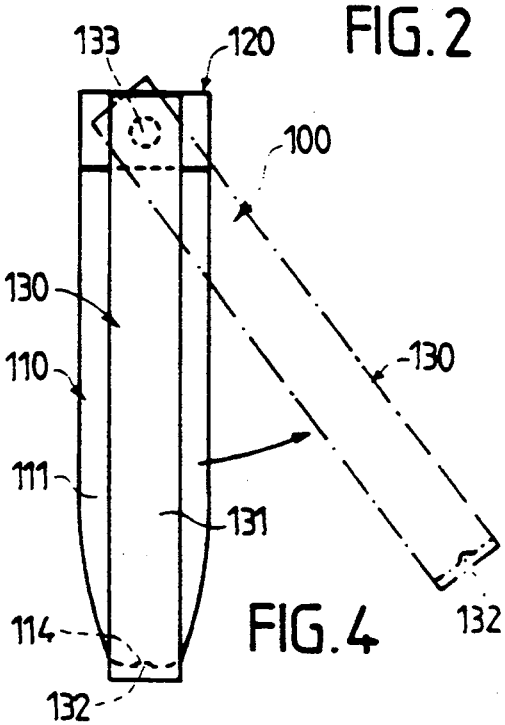
FIGS. 4 and 5 show, in perspective, a variant of the applicator according to the invention, in the closed position (FIG. 4) and during opening (FIG. 5)
Figure 5:
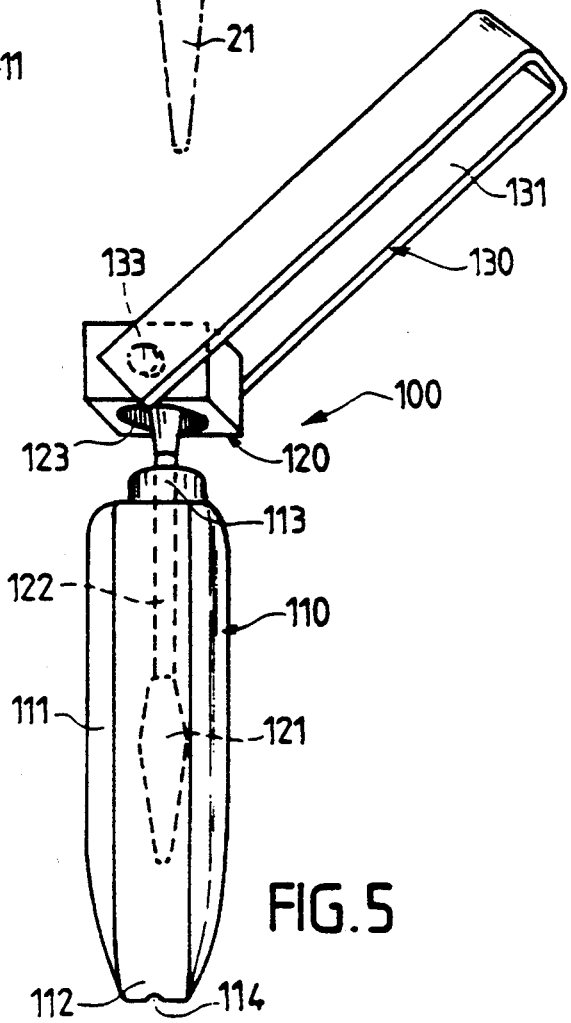

According to the variant in FIGS. 4 and 5, the applicator 100 has an arch 131 provided in order to fit over the widest longitudinal faces of the body 111 of the reservoir 110; thus, as the cross section of the cap 120 has the shape of a rectangle, the axis 133 extends parallel to a small side of the said rectangle; the arch 131 has the form of a strip folded up into a U, the ends of the strip facing each other after folding. FIG. 5 shows that the body 111 of the reservoir 110 has a neck 113 bordering the mouth of the reservoir 110 and forming a seat which is adapted in order to interact in a leaktight manner with a housing in the cap 120 equipped with a closure bearing surface 123. According to this variant, the end of the body 111 becomes narrower towards the base of the reservoir 110 which carries the counterstop 114 which interacts with the locking stop 132 of the arch 131 which includes of a central stud provided on the bar linking the two branches of the U of the arch 131.

Figures 6, 7, 8:
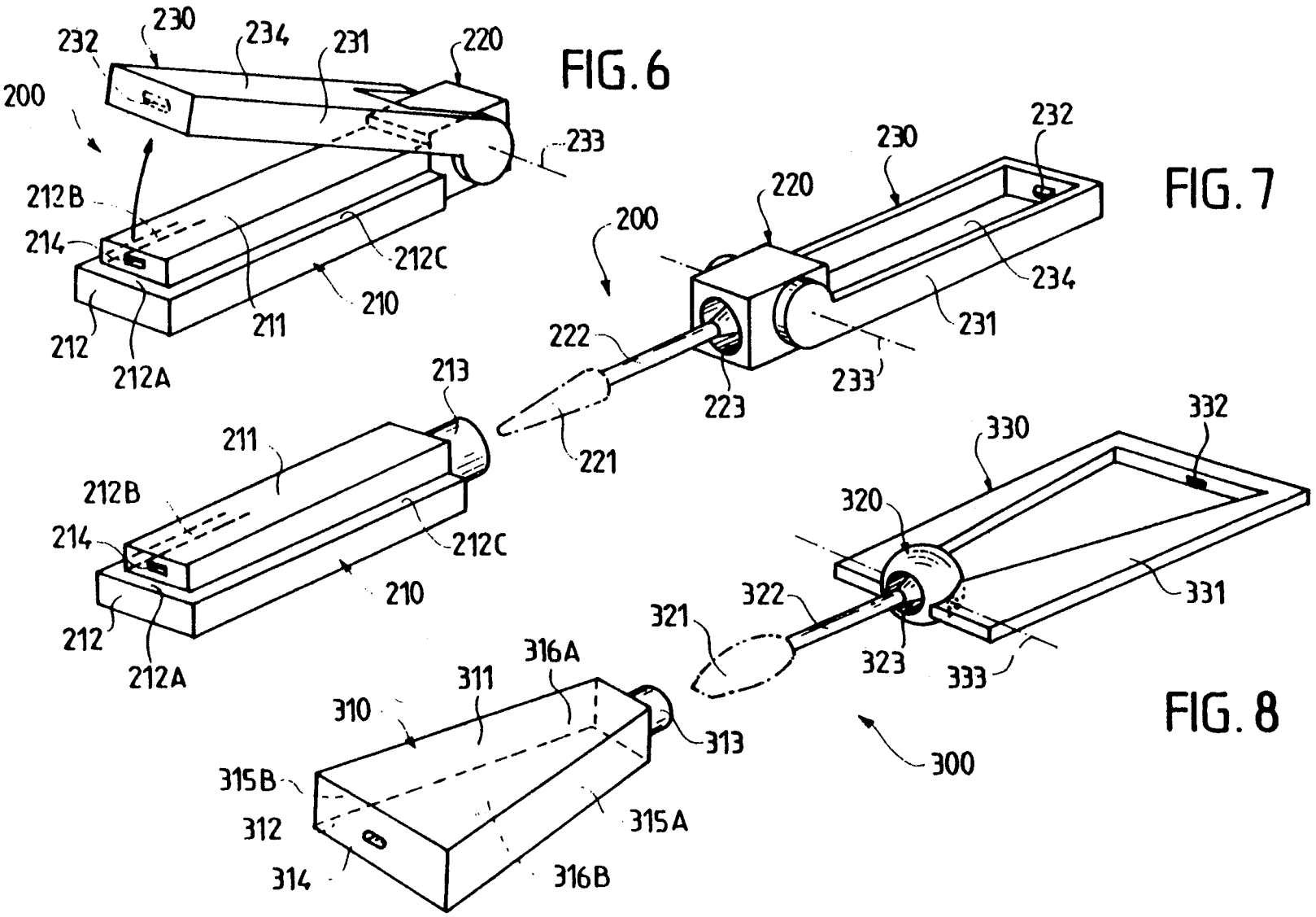
FIGS. 6 and 7 are similar to FIGS. 4 and 5, but relate to a further variant of the applicator according to the invention.
FIG. 8 shows, in perspective, an applicator according to the invention in the open position.

The applicator 200 shown in FIGS. 6 and 7 includes a reservoir 210, of which two longitudinal parallel faces as well as the base 212 have recesses 212B, 212C, 212A, respectively, in which the arch 231 of the handle 230 is received; to this end, the arch 231 is of the same type as the arch 131 of the applicator 100, but its longitudinal plane of symmetry does not pass through the axis 233 and is thus offset with respect to this axis; according to this variant, the arch 231 is closed on one side by a wall 234.

The body 311 of the reservoir of the applicator 300 in FIG. 8 has two wide parallel trapezoidal faces 316A, 316B connected by narrower faces 315A, 315B and a base 312. A handle 330, the arch 331 of which is a plate of rectangular shape in which an opening of trapezoidal shape corresponding to the faces 316A, 316B of the body 311 has been made, is articulated on the cap 320, in this case of general spherical shape.

It should be noted that, according to the invention, the close interaction between the handle and the reservoir in the closed position of the applicator automatically positions, for aesthetic purposes, the cap with respect to the reservoir, it being possible for the cap and the reservoir to then have shapes which are not necessarily axisymmetrical and for which it is thus unnecessary to provide stops for indexing one piece with respect to the other.

We claim:

1. Applicator for a cosmetic product to be applied, comprising:

a reservoir containing the product;

a removable cap closing a mouth of said reservoir, said cap having a closure bearing surface to interact with a seat at the mouth of the reservoir;

an application member connected to an end of a rod extending only from inside the cap; and a handle for the cap articulated about an axis of the cap and pivotable between a folded-up compact position against the reservoir and an extended position at an angle to the reservoir, said handle including at least one arch of which the dimensions are such that, in the folded-up position, said arch surrounds said reservoir, said arch being equipped with a locking stop interacting with a base of said reservoir, the interaction holding said closure bearing surface of said cap in a leaktight manner on said seat.

2. Applicator according to claim 1, wherein the application member comprises a brush.

3. Applicator according to claim 1, wherein said base of said reservoir includes a positioning counterstop that cooperates with said locking stop of said arch.

4. Applicator according to claim 1, wherein a cross section of the reservoir and the arck is the shape of a rectangle.

5. Applicator according to claim 4, wherein the axis of articulation of the handle is parallel to a small side of the rectangle.

6. Applicator according to claim 4, wherein the axis of articulation of the handle is parallel to a large side of the rectangle.

7. Applicator according to claim 1, wherein a longitudinal section of the reservoir is the shape of a trapezium and the arch corresponds to this trapezoidal shape.

8. Applicator according to claim 7, wherein the arch is a rectangular plate having an opening of trapezoidal shape.

9. Applicator according to claim 1, wherein the reservoir has, at a periphery thereof, recesses in which the arch is received.

10. Applicator according to claim 9, wherein the arch is closed on one side by a wall.

11. The applicator as recited in claim 1, wherein the articulation of the handle between said folded-up and extended positions defines use positions of the handle with respect to the cap.

* * * * *